US011890504B2

(12) United States Patent
Byun

(10) Patent No.: US 11,890,504 B2
(45) Date of Patent: Feb. 6, 2024

(54) ARM CURL FITNESS APPARATUS

(71) Applicant: NEWTECH WELLNESS CO., LTD., Gimhae-si (KR)

(72) Inventor: Hyun Jung Byun, Busan (KR)

(73) Assignee: NEWTECH WELLNESS CO., LTD., Gimhae-si (KR)

( * ) Notice: Subject to any disclaimer, the term of this patent is extended or adjusted under 35 U.S.C. 154(b) by 127 days.

(21) Appl. No.: 17/605,001

(22) PCT Filed: Nov. 11, 2020

(86) PCT No.: PCT/KR2020/015765
§ 371 (c)(1),
(2) Date: Oct. 20, 2021

(87) PCT Pub. No.: WO2022/080562
PCT Pub. Date: Apr. 21, 2022

(65) Prior Publication Data

US 2022/0305334 A1 Sep. 29, 2022

(30) Foreign Application Priority Data

Oct. 13, 2020 (KR) ..... 10-2020-0132143

(51) Int. Cl.
*A63B 23/12* (2006.01)
*A63B 21/00* (2006.01)
*A63B 21/06* (2006.01)

(52) U.S. Cl.
CPC .... *A63B 23/1281* (2013.01); *A63B 21/00069* (2013.01); *A63B 21/0615* (2013.01);
(Continued)

(58) Field of Classification Search
CPC ..... A63B 21/00058; A63B 21/00061; A63B 21/00065; A63B 21/00069;
(Continued)

(56) References Cited

U.S. PATENT DOCUMENTS 4,720,099 A * 1/1988 Carlson ..... A63B 21/0052 482/901
5,273,504 A * 12/1993 Jones ..... A63B 23/1263 482/133
5,273,505 A * 12/1993 Jones ..... A63B 21/0615 482/133
7,922,629 B1 * 4/2011 Batca ..... A63B 23/1263 482/92
7,922,630 B1 * 4/2011 Batca ..... A63B 23/12 482/142

(Continued)

FOREIGN PATENT DOCUMENTS

JP 2016-168337 A 9/2016
KR 20-2011-0011848 U 12/2011
KR 10-1197930 B1 11/2012

OTHER PUBLICATIONS

International Search Report for PCT/KR2020/015765 dated Jul. 12, 2021 from Korean Intellectual Property Office.

*Primary Examiner* — Gary D Urbiel Goldner
(74) *Attorney, Agent, or Firm* — Revolution IP, PLLC

(57) ABSTRACT

An arm curl fitness apparatus includes a first frame configured to be provided standing upright on both sides of a user in a straight bar shape; a second frame formed in a U-shape with each end coupled to an upper end of the first frame; a first rotation bar, shorter than the first frame, with one end rotatably coupled to an upper outer side of the first frame; a handle formed in an L-shape with one end rotatably coupled to the first rotation bar and another end configured to face the user; a second rotation bar with one end rotatably coupled to a lower outer side of the first frame; a wire with one end connected to a point adjacent to one end of the first rotation bar; and an armrest provided on an inside of the upper part of the first frame.

5 Claims, 7 Drawing Sheets

(52) U.S. Cl.
CPC ..... *A63B 21/154* (2013.01); *A63B 21/4035* (2015.10); *A63B 2225/09* (2013.01)

(58) Field of Classification Search
CPC ... A63B 21/0615; A63B 21/15; A63B 21/151; A63B 21/154; A63B 21/159; A63B 21/4017; A63B 21/4027; A63B 21/4029; A63B 21/4031; A63B 21/4033; A63B 21/4035; A63B 21/4039; A63B 21/4047; A63B 21/4049; A63B 23/035; A63B 23/03508; A63B 23/03516; A63B 23/03533; A63B 23/03541; A63B 23/12; A63B 23/1281; A63B 69/0057; A63B 2208/0228; A63B 2208/0233; A63B 2225/09; A63B 2225/093; A63B 2244/09
See application file for complete search history.

(56) References Cited

U.S. PATENT DOCUMENTS

| | | | | |
|---|---|---|---|---|
| 7,938,761 | B2 * | 5/2011 | Simonson | A63B 21/0615 482/136 |
| 2002/0058572 | A1 * | 5/2002 | Karasawa | A63B 21/4047 482/99 |
| 2008/0058181 | A1 | 3/2008 | Webber et al. | |
| 2010/0009818 | A1 | 1/2010 | Simonson et al. | |
| 2014/0057761 | A1 * | 2/2014 | Higgins | A63B 23/1209 482/94 |
| 2014/0080684 | A1 * | 3/2014 | Shields | A63B 21/06 482/100 |
| 2016/0114210 | A1 * | 4/2016 | Giannelli | A63B 21/4047 482/133 |
| 2017/0216663 | A1 | 8/2017 | Giannelli et al. | |
| 2018/0229076 | A1 * | 8/2018 | Nalley | A63B 21/154 |

* cited by examiner

【Figure 1】
- Prior Art -
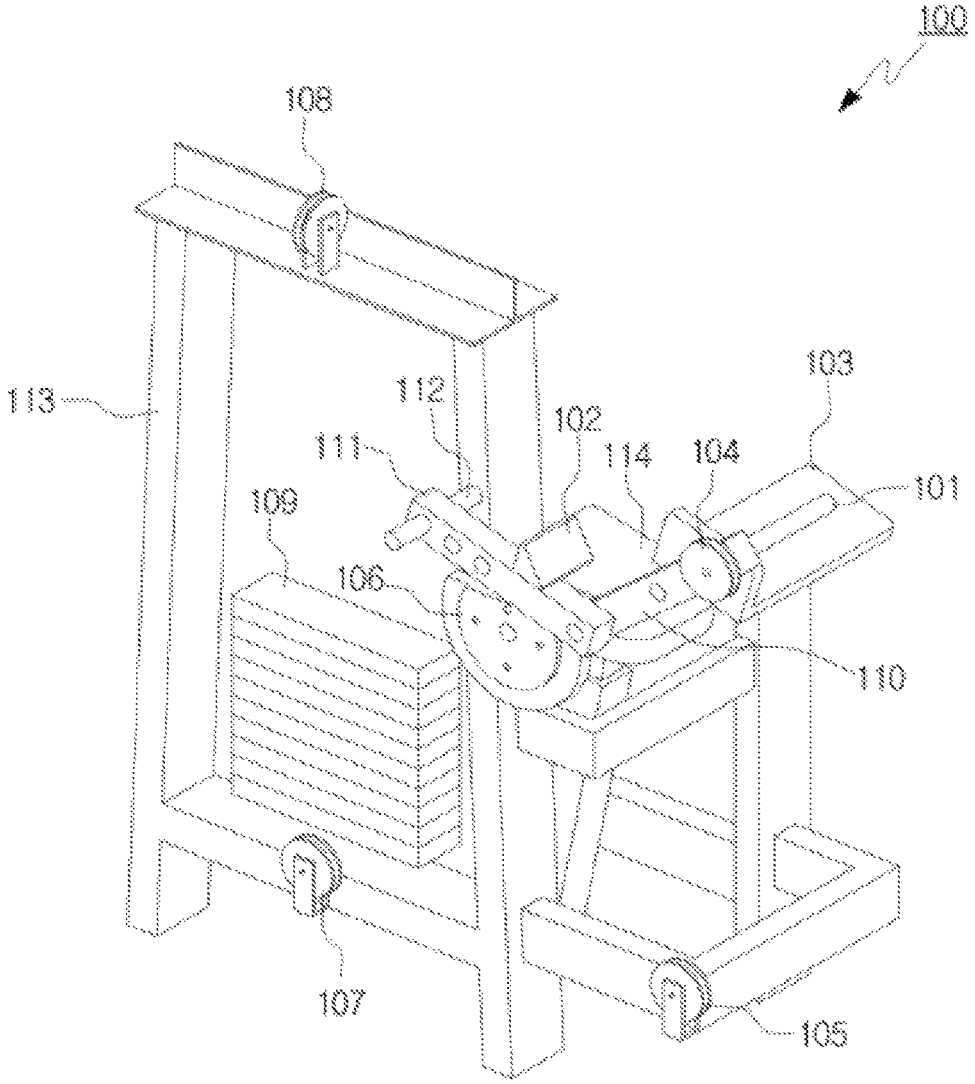

【Figure 2】
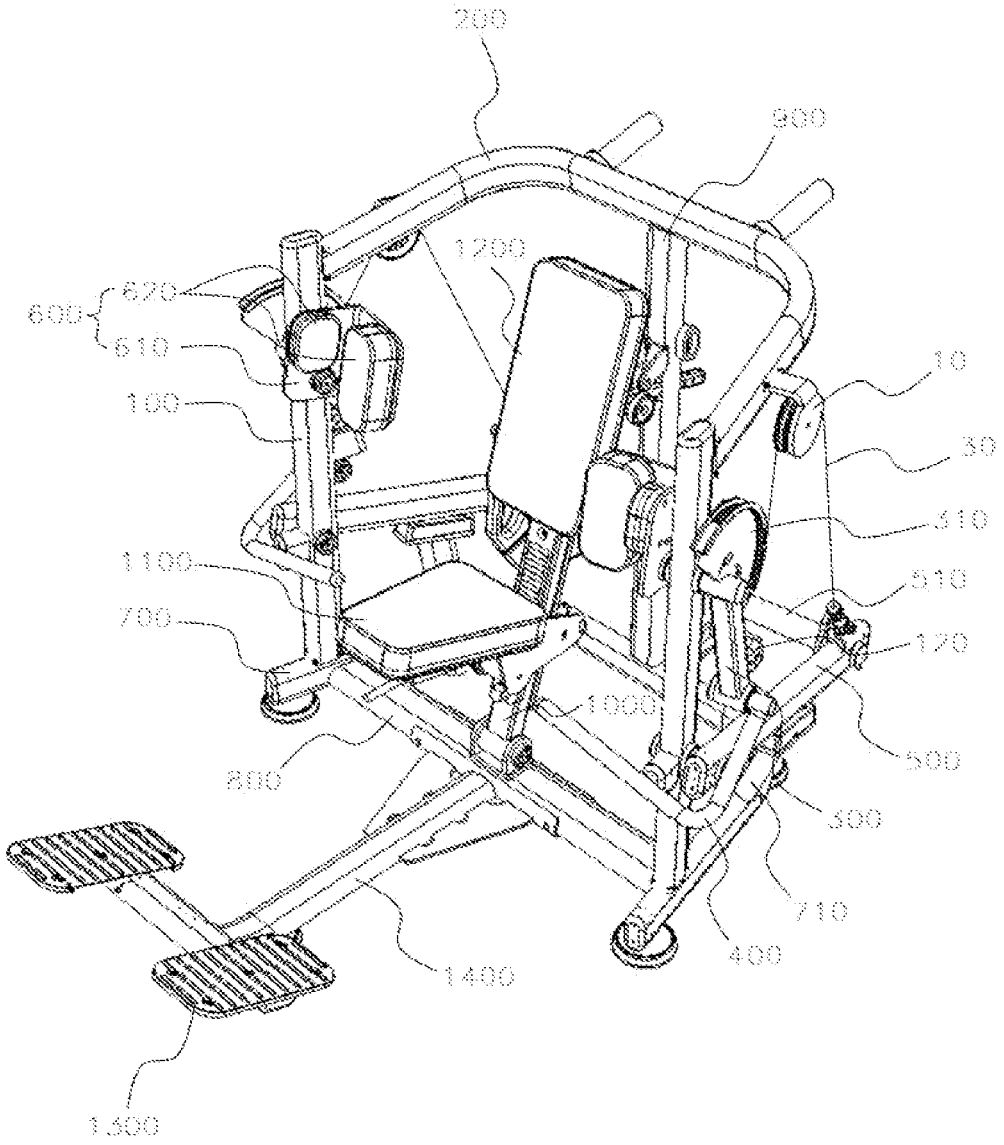

【Figure 3】
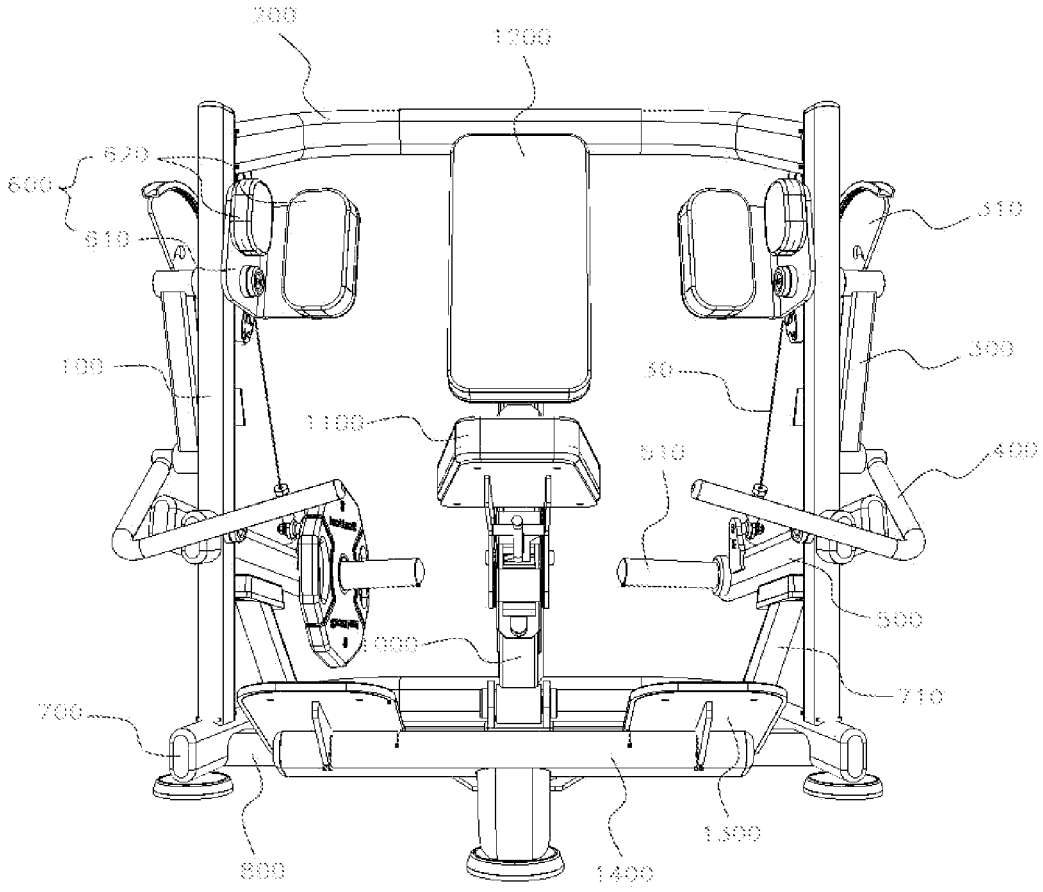

【Figure 4】
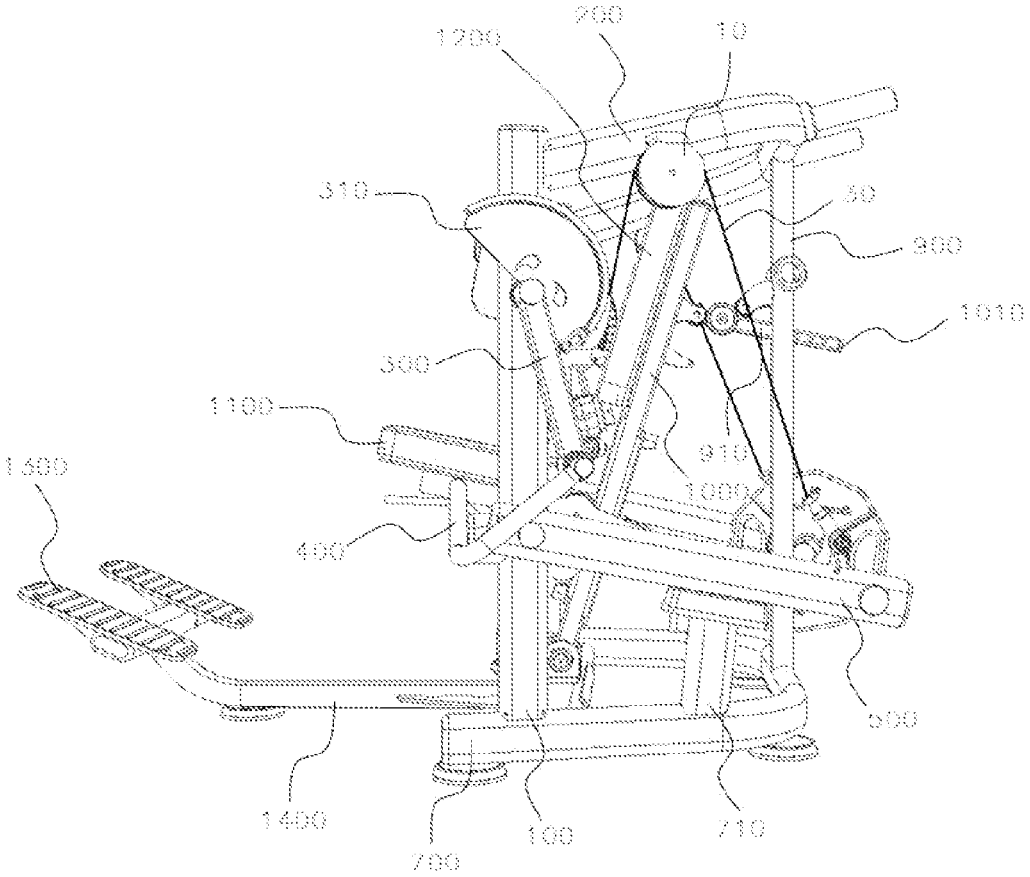

【Figure 5】
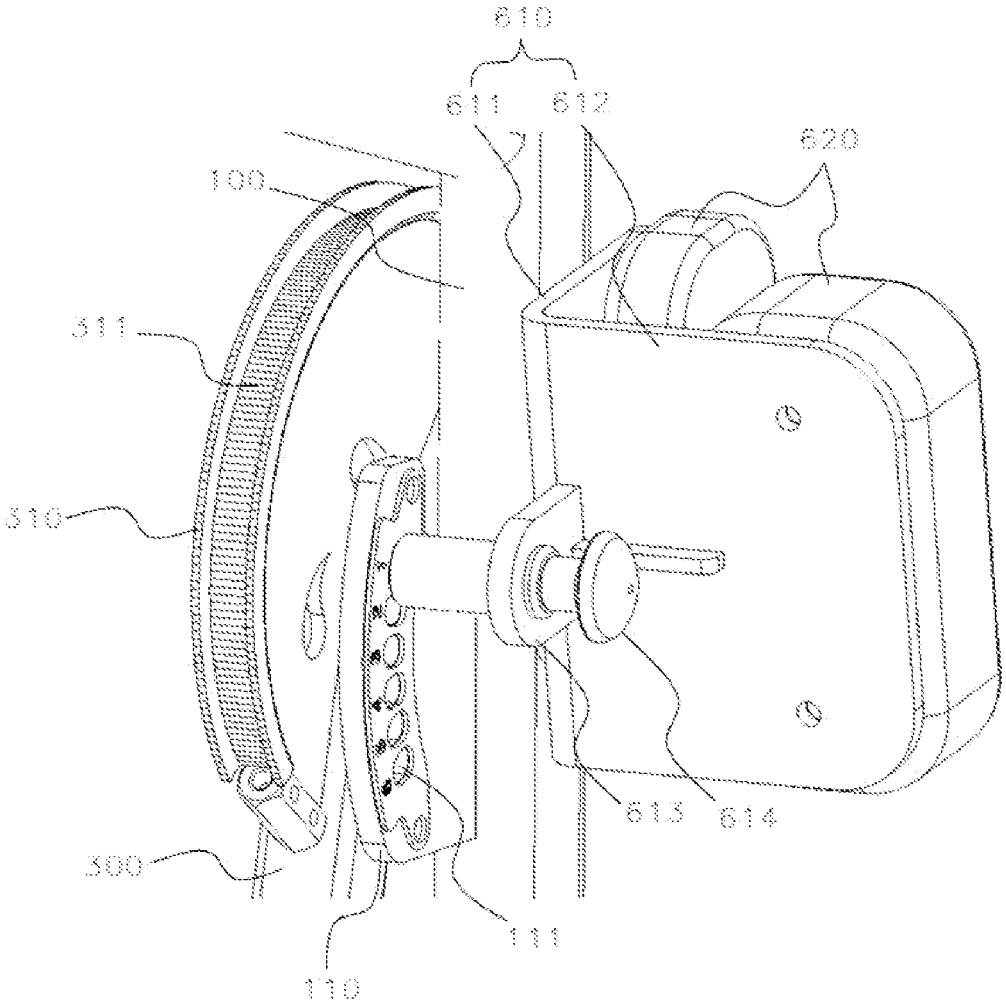

【Figure 6】
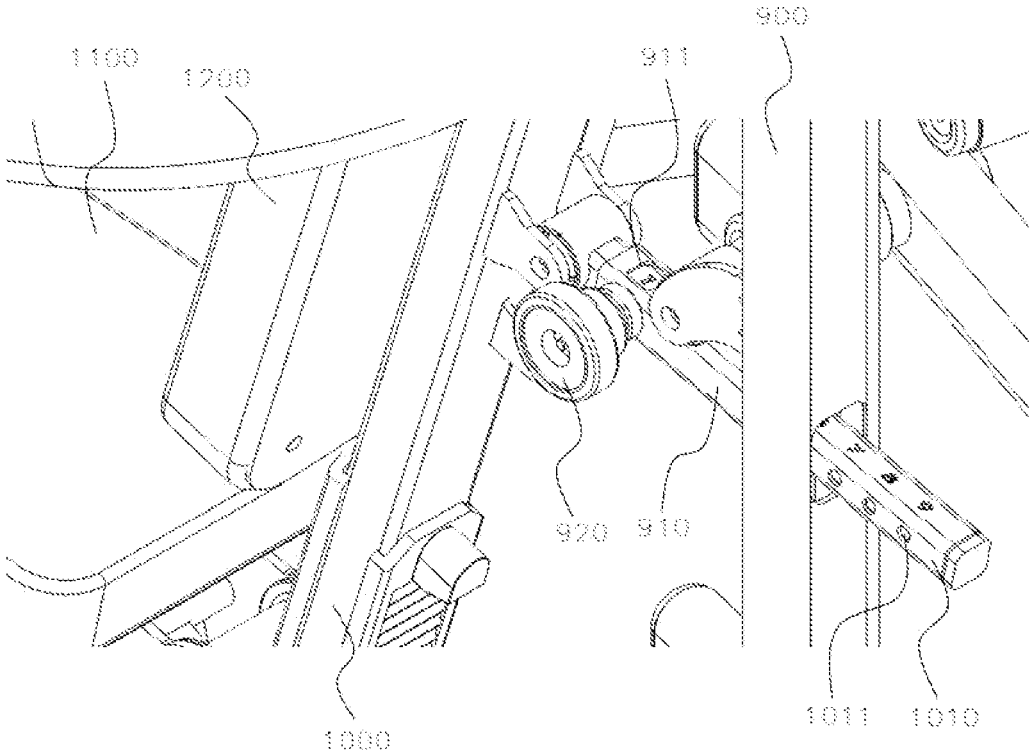

【Figure 7】
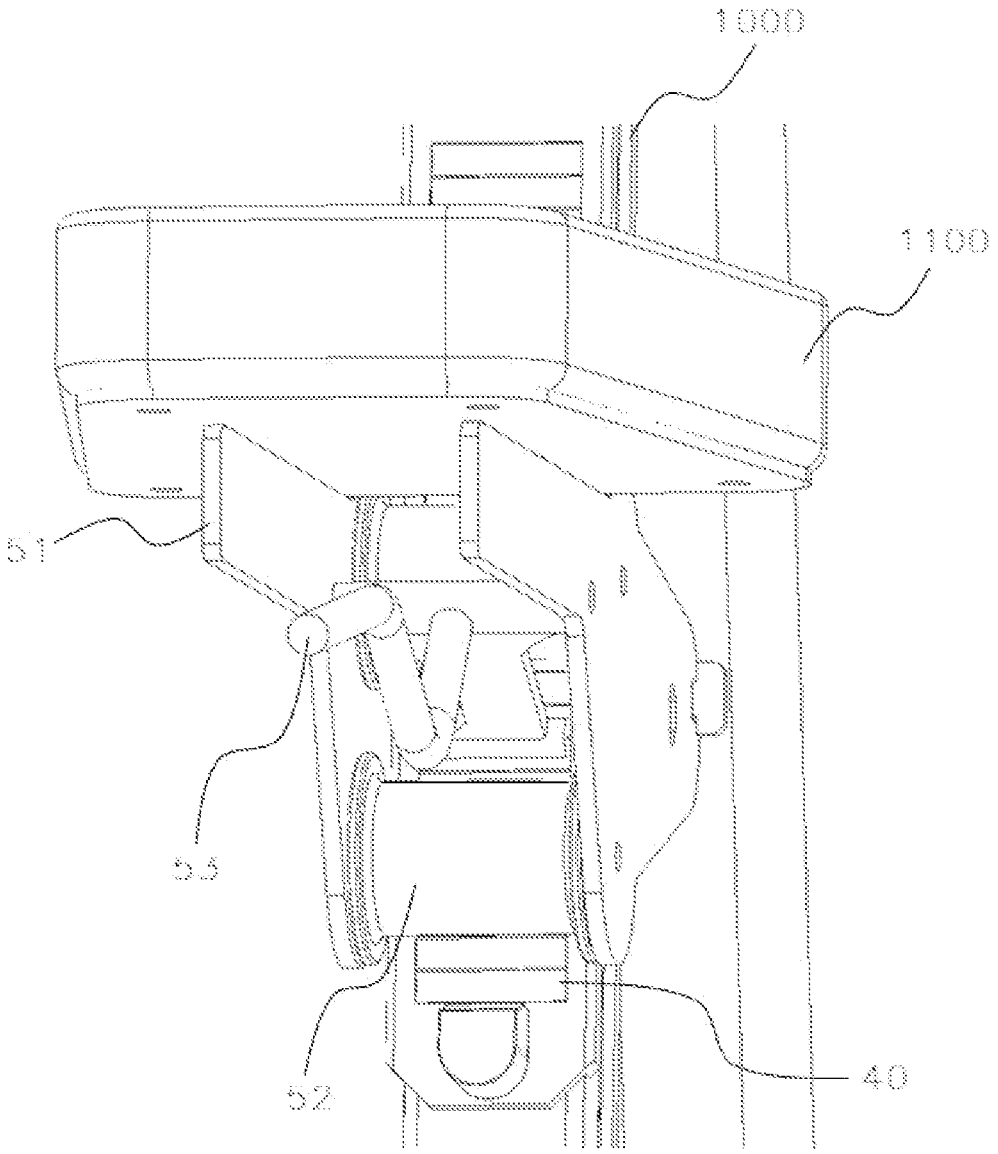

ARM CURL FITNESS APPARATUS

TECHNICAL FIELD

The present invention relates to an arm curl fitness apparatus, and more particularly, to an arm curl fitness apparatus capable of variously controlling a stimulation region of a biceps muscle.

BACKGROUND ART

Recently, as social interest in health increases along with the increase in leisure time, more and more people are trying to improve muscle strength and create a balanced body through weight training that means an exercise aimed at strengthening muscles by using an object having a predetermined weight, such as a barbell or a dumbbell, and thereby improving physical strength.

The arm curl machine, one of the exercise equipment used for such weight training, allows the user to repeatedly contract and relax their biceps to grow the muscles of the biceps and increase muscle strength. Korean Patent Registration No. 10-1197930 (hereinafter referred to as 'cited invention') discloses an arm curl fitness apparatus.

In the cited invention, as shown in FIG. 1, the user sits on the saddle (114), mounts the upper part of the arm on the upper arm support pad (103), and then holds the handle (101) with both hands and lifts it upward, thereby bending the fore part of the arm toward the upper arm. However, since the angle of the upper arm support pad (103) of the cited invention is constantly fixed, stimulation is applied only to a specific part of the biceps muscle, so the user is performing additional exercise using dumbbells, etc. to apply stimulation to various parts of the biceps.

PRIOR ART DOCUMENTS

Patent Documents (Patent Document 1) 1. Korea Patent Registration No. 10-1197930: An arm curl fitness apparatus that can induce upper arm movements to develop various muscles

SUMMARY OF INVENTION

Problems to be Solved

The present invention, with a view to solving the above problem, aims to provide an arm curl fitness apparatus that can be adjusted to apply stimulation to various parts of the biceps muscle, and thus can effectively develop muscle and strength for the entire biceps region.

Solution to Problem

The present invention for achieving the above object, an arm curl fitness apparatus, comprises a first frame to be provided standing upright on both sides of the user in a straight bar shape; a second frame formed in a U-shape with each end coupled to the upper end of the first frame, inclined upwardly toward the rear, and protruding in both directions to be provided with a fixed pulley; a first rotation bar, shorter than the first frame, with one end rotatably coupled to the upper outer side of the first frame, and disposed downward; a handle formed in a L-shape with one end rotatably coupled to the first rotation bar and the other end facing the user; a second rotation bar with one end rotatably coupled to the lower outer side of the first frame, the other end fitted with a predetermined weight, and disposed to be inclined downwardly toward the rear; a wire with one end connected to a point adjacent to one end of the first rotation bar, and the other end connected to a point adjacent to the other end of the second rotation bar while wrapping around the upper side of the fixed pulley; and an armrest provided on the inside of the upper part of the first frame to support the user's triceps from the rear and to adjust the angle of inclination to the ground.

In addition, the first frame comprises a fixed plate that forms a plate shape to be erected toward the rear at a point adjacent to the armrest; the armrest is extended so that the first fixing part and the second fixing part, forming the plate shape, are orthogonal to each other; the first fixing part is rotatably coupled to the upper inner side of the first frame; the armrest plate with a fixing piece protruding toward the outer side of the second fixing part; and cushion members provided on the inner surface of the first fixing part and on the inner surface of the second fixing part, wherein the fixing piece is provided with a first fixing pin to be inserted into the first fixing hole formed through the fixed plate, and a plurality of first fixing holes may be formed through the fixed plate along an imaginary fixing line on which the first fixing pin is positioned according to the rotation of the armrest.

In addition, on one end side of the first rotation bar, a guide plate is provided integrally with the first rotation bar to form a semicircle around one end of the first rotation bar and to be erected toward the rear, and the guide plate has a wire receiving groove along the circumference so that the wire positioned between the one end side of the first rotation bar and the fixed pulley may be guided while being positioned in the wire receiving groove.

The present invention further comprises a third frame to be placed on the ground in a U-shape, with each end coupled to the lower ends of the first frame, and to be arranged horizontally toward the rear; a fourth frame connecting both ends of the third frame; a fifth frame vertically connecting the center of the second frame and the center of the third frame; a sixth frame hinged to the upper center of the third frame to rotate in the front-rear direction; a saddle coupled to the sixth frame to support the user's buttocks; and a backrest coupled to the upper side of the saddle on the sixth frame to support the user's back. In addition, the sixth frame is provided with an angle control bar having one end hinged to the rear of the sixth frame, disposed toward the fifth frame, and having a plurality of second fixing holes penetrated in the longitudinal direction; and the fifth frame has a protruding fixing bar into which the angle control bar is inserted while being disposed to face the sixth frame, and may comprise a second fixing pin penetrating the fixing bar and passing through any one of a plurality of second fixing holes.

In addition, the saddle may be coupled to the sixth frame so as to be movable along the longitudinal direction of the sixth frame and fixed at one point.

Beneficial Effects

According to the present invention, users can effectively develop the muscles and strength of the entire biceps muscle by applying stimulation to various parts of the biceps because they can do arm curl exercises that stimulate the biceps while adjusting the angle of the armrest that supports the triceps.

In addition, by adjusting the angle of the backrest, users can widen the stimulation area of the biceps and perform arm curl exercise by adjusting the height of the saddle to suit their physical condition.

BRIEF DESCRIPTION OF DRAWINGS

FIG. 1 is a perspective view showing the structure of a conventional Arm curl fitness apparatus;

FIG. 2 is a perspective view showing an arm curl fitness apparatus according to the present invention;

FIG. 3 is a front view showing an arm curl fitness apparatus according to the present invention;

FIG. 4 is a side view showing an arm curl fitness apparatus according to the present invention;

FIG. 5 is an enlarged partial view showing the angle adjustment structure of the armrest applied to an arm curl fitness apparatus according to the present invention;

FIG. 6 is an enlarged partial view showing the angle adjustment structure of the backrest applied to an arm curl fitness apparatus according to the present invention; and FIG. 7 is an enlarged partial view showing the height control structure of the saddle applied to an arm curl fitness apparatus according to the present invention.

BEST MODE FOR CARRYING OUT THE INVENTION

The present invention proposes an arm curl fitness apparatus that comprises a first frame to be provided standing upright on both sides of the user in a straight bar shape so that it can be adjusted to apply stimulation to various parts of the biceps and to effectively develop muscles and strength for the entire biceps; a second frame formed in a U-shape with each end coupled to the upper end of the first frame, inclined upwardly toward the rear, and protruding in both directions to be provided with a fixed pulley; a first rotation bar, shorter than the first frame, with one end rotatably coupled to the upper outer side of the first frame, and disposed downward; a handle formed in a L-shape with one end rotatably coupled to the first rotation bar and the other end facing the user; a second rotation bar with one end rotatably coupled to the lower outer side of the first frame, the other end fitted with a predetermined weight, and disposed to be inclined downwardly toward the rear; a wire with one end connected to a point adjacent to one end of the first rotation bar, and the other end connected to a point adjacent to the other end of the second rotation bar while wrapping around the upper side of the fixed pulley; and an armrest provided on the inside of the upper part of the first frame to support the user's triceps from the rear and to adjust the angle of inclination to the ground.

The scope of the present invention is not limited to the embodiments described below, and various modifications may be made by those of ordinary skill in the art without departing from technical spirit of the present invention.

Hereinafter, the present invention, an arm curl fitness apparatus, will be described in detail with reference to the attached FIGS. 1 to 7.

As shown in FIGS. 2 to 4, an arm curl fitness apparatus of the present invention basically comprises a first frame (100), a second frame (200), a first rotation bar (300), a handle (400), a second rotation bar (500) , a wire (30), and an armrest (600).

The first frame (100) is provided standing upright on both sides with respect to the user while forming a straight bar shape. The second frame (200) forms a U-shape, with both ends coupled to the upper end of the first frame (100), respectively, and is disposed to be inclined upwardly toward the rear. And the second frame (200) protrudes in both directions to be provided with a fixed pulley (10). That is, the second frame (200) is disposed toward the rear, and protruding outward to be provided with a fixed pulley (10), respectively, in its two parts facing each other.

The first rotation bar (300), shorter than the first frame (100), is disposed downward with one end rotatably coupled to the upper outer side of the first frame (100). The first frame (100) may be provided with a first rotation limiter (120) for limiting the rotation of the first rotation bar (300) while supporting the portion adjacent to the other end of the first rotation bar (300) from the rear. The other end of the first rotation bar (300) is provided with a handle (400) that the user can grip by hand, where the handle (400) forms an L-shape, and one end is rotatably coupled to the other end of the first rotation bar (300) and the other end is provided to face the user. Therefore, when the user does not lift the handle (400), the first rotation bar (300) is supported by the first rotation limiter (120) in a downwardly disposed state.

The second rotation bar (500) is formed in a straight with one end rotatably coupled to the lower outer side of the first frame (100) and the other inclined downward toward the rear. The other end of the second rotation bar (500) is configured to fit a weight (20) having a predetermined weight. In one embodiment, the other end of the second rotation bar (500) may have a fitting rod (510) protruding in the inner direction while forming a rod shape, and the fitting rod (510) may be fitted with a weight (20) having a fitting hole in the center, such as a barbell. Accordingly, the user can adjust the exercise intensity by adjusting the weight or the number of weights (20) fitted to the fitting rod (510).

Specifically as shown in FIG. 4, the wire (30), which serves to link the first rotation bar (300) and the second rotation bar (500) so that the second rotation bar (500) can rotate according to the rotation of the first rotation bar (300), has one end connected to a point adjacent to one end of the first rotation bar (300), and the other end connected to a point adjacent to the other end of the second rotation bar (500) while wrapping around the upper side of the fixed pulley (10).

And when the first rotation bar (300) rotates forward, a guide plate (310) may be provided at one end of the first rotation bar (300) so that the second rotation bar (500) is easily lifted.

The guide plate (310) may be formed in a semicircular shape around one end of the first rotation bar (300) as an embodiment, and may be provided to stand up toward the rear. The guide plate (310) may be provided to be integral with the first rotation bar (300) so that it can rotate together with the first rotation bar (300) when the first rotation bar (300) rotates. The guide plate (310) has a wire receiving groove (311) recessed along the circumference. Accordingly, the wire (30) positioned between the one end side of the first rotation bar (300) and the fixed pulley (10) may be guided while being positioned in the wire receiving groove (311).

For example, when the first rotation bar (300) is directed downward and the second rotation bar (500) is inclined downward, the wire (30) is positioned in the wire receiving groove (311) only at about ⅕ of the total length of the wire receiving groove (311), and when the first rotation bar (300) is directed forward and the second rotation bar (500) is inclined upward, the wire (30) is positioned in the wire receiving groove (311) at a portion of ½ or more of the total length of the wire receiving groove (311). The guide plate (310) also serves to maintain the wire (30) in a taut state even when the first rotation bar (300) and the second rotation bar (500) rotate repeatedly.

On the other hand, in the present invention, the armrest (600) is provided so that the user can perform arm curl exercise in the manner described above while fixing brachial muscle. The armrest (600) is provided in the upper inner side of the first frame (100) so as to support the user's triceps from the back, and to adjust the angle of inclination to the ground.

In a specific embodiment, the armrest (600) may, as shown in FIG. 5, comprise an armrest plate (610) in which the first fixing part (611) and the second fixing part (612) are extended in a plate shape to be orthogonal to each other; and a cushion member (620) to be provided on the inner surface of the first fixing part (611) and the inner surface of the second fixing part (612). The cushion member (620) provided on the inner surface of the first fixing part (611) supports the triceps from the side, and the cushion member (620) provided on the inner surface of the second fixing part (612) supports the triceps from the rear.

In this armrest (600), the first fixing part (611) is rotatably coupled to the upper inner side of the first frame (100), and when considering the inclination angle of the armrest (600), it is preferable that the lower part of the first fixing part (611) is coupled to the first frame (100). In addition, the second fixing part (612) has a fixing piece (613) protruding outward, that is, toward the rear. The fixing piece (613) may be formed in a plate shape to stand up against the second fixing part (612). And, the first frame (100) is provided with a fixed plate (110) in a plate shape to be erected toward the rear at a point adjacent to the armrest (600). At this time, the fixing piece (613) is provided with a first fixing pin (614) to be inserted into the first fixing hole (111) that is formed through the fixed plate (110), and the fixed plate (110) has a plurality of first fixing holes (111) formed along an imaginary fixing line on which the first fixing pin (614) is positioned according to the rotation of the armrest (600).

By adjusting the angle of the armrest (600) as described above, the user can perform an arm curl exercise that stimulates the biceps while adjusting the angle at which the brachial muscle is supported and effectively develop the muscles and strength of the entire biceps.

On the other hand, as shown in FIGS. 2 to 4, an arm curl fitness apparatus of the present invention may further comprise a third frame (700), a fourth frame (800), a fifth frame (900), a sixth frame (1000), a saddle (1100), and a backrest (1200).

The third frame (700) is placed on the ground in a U-shape to support the configuration positioned on the upper side. The lower ends of the first frame (100) are coupled to both ends of the third frame (700), respectively, and are arranged horizontally toward the rear. In addition, floor packings made of a material having frictional force such as rubber, etc., may be provided at predetermined intervals to prevent sliding in a state of being placed on the ground. And in the third frame (700), a second rotation limiter (710) that supports the second rotation bar (500) while limiting the downward movement of the second rotation bar (500) is provided upward at a point located below the part slanted toward the other end of the second rotation bar (500). At this time, the second rotation bar (500) in contact with the second rotation limiter (710) is supported so as to be inclined downwardly toward the rear.

The fourth frame (800) connects both ends of the third frame while forming a straight bar shape. The fifth frame (900) vertically connects the center of the second frame (200) and the center of the third frame (700) while forming a straight shape. That is, the portion arranged in the lateral direction in the second frame (200) and the portion arranged in the lateral direction in the third frame (700) are parallel to each other. The sixth frame (1000) is hinged to rotate in the front-rear direction on the upper center of the third frame (700) while forming a straight bar shape.

The saddle (1100) has a plate shape with a predetermined thickness and is coupled to the sixth frame (1000) in a configuration in which the user's buttocks are seated, and is provided to face the front of the sixth frame (1000). The backrest 1200 has a plate shape having a predetermined thickness and has a configuration in which the user's back is supported, and is coupled to the sixth frame 1000 above the saddle 1100. At this time, the backrest (1200) is provided so as to be orthogonal to the saddle (1100) and parallel to the longitudinal direction of the sixth frame (1000).

In particular, a backrest (1200) may be configured to be able to adjust the inclined angle. For this purpose, as shown in FIG. 6, the sixth frame (1000) may have an angle control bar (1010) whose one end is hinged to the rear of the sixth frame (1000) and disposed to face the fifth frame (900), and the fifth frame (900) may have a fixing bar (910) into which the angle control bar (1010) is inserted while being set to face the sixth frame (1000).

At this time, the angle control bar (1010) is preferably hinged to a point corresponding to the center of the backrest (1200) so that the user's back can be stably supported, and a plurality of second fixing holes (1011) may be formed to penetrate along the longitudinal direction. A plurality of second fixing holes (1011) are formed to penetrate in the lateral direction of the angle control bar (1010), and on the upper surface of the angle control bar (1010), a symbol indicating each step of the inclination may be displayed at each point corresponding to each second fixing hole (1011). In addition, a fixing bar (910) has a sighthole (911) formed through the upper surface of one end adjacent to the sixth frame (1000) so that the user can see the symbol displayed on the angle control bar (1010) through the sighthole, memorize the desired inclination step of the backrest (1200), and easily have the desired inclination even when the inclination of the backrest (1200) is changed.

In addition, the fifth frame (900) may comprise a second fixing pin (920) passing through any one of the plurality of second fixing holes (1011) while penetrating a point adjacent to the sixth frame (1000) in the fixing bar (910). Here, the second fixing pin (920) is provided separately from the fixing bar (910), and can fix the backrest (1200) not only by penetrating any one of the fixing bar (910) and a plurality of second fixing holes (1011) but also by being integrated with the fixing bar (910) and elastically protruding toward any one of the plurality of second fixing holes (1011).

As described above, in the present invention, since the user can change the part of the biceps to be stimulated during exercise while adjusting the angle of the backrest (1200), adjusting the angle of the backrest (1200) serves to control the stimulation area of the biceps muscle more widely along with the angle adjustment of the armrest (600).

In addition, the saddle (1100) may be coupled to the sixth frame (1000) so as to be movable along the longitudinal direction of the sixth frame (1000) and fixed at one point. That is, since the height of the saddle (1100) is adjustable, the user can adjust the saddle (1100) to suit his or her physical condition and then perform the arm curl exercise.

In an embodiment, the saddle (1100) and the sixth frame (1000) may be coupled through an interlocking member as shown in FIG. 7. In this case, the sixth frame (1000) has a lever stop (40) formed on the front surface at predetermined intervals along the longitudinal direction. The interlocking member may comprise two interlocking plates (51) that is erected on the bottom of the saddle (1100); an interlocking roller (52) whose both ends are rotatably coupled to the two interlocking plates (51) while forming a cylindrical shape and are moved when they come into contact with the sixth frame (1000) along the longitudinal direction of the sixth frame (1000); and a height control lever (53) that is rotatably coupled to the two interlocking plates (51) and caught on the lever stop (40) when it is rotated in one direction.

That is, the user can rotate the height control lever (54) in the other direction to release the catch of the height control lever (53), easily move the saddle (1100) along the longitudinal direction of the sixth frame (1000) through the interlocking roller (52) to adjust the height, and then rotate the height control lever (54) in one direction so that the height control lever (53) can be caught on the lever stop (40).

On the other hand, in the present invention, a foot plate (1300) may be provided so that the user can place his or her feet while sitting on the saddle (1100). The foot plate (1300), in one embodiment, may be provided in the seventh frame (1400) that forms a straight line from the center of the fourth frame (800) toward the front and whose ends extend by a predetermined length in both directions, and may be provided at the ends of the portions extending in both directions from the seventh frame(1400), respectively. In this case, the foot plate (1300) may be provided to be spaced apart from the ground by a predetermined height, and may be provided so that an angle facing the opposite direction of the user's position forms an acute angle to the ground. Therefore, the user can perform arm curl exercise while sitting on the saddle (1100) and putting his or her feet on the foot plate (1300).

| Description of Signs | |
|---|---|
| 10: fixed pulley | 20: weight |
| 30: wire | 40: lever stop |
| 51: interlocking plate | 52: interlocking roller |
| 53: height control lever | |
| 100: first frame | 110: fixed plate |
| 111: first fixing hole | 120: first rotation limiter |
| 200: second frame | |
| 300: first rotation bar | 310: guide plate |
| 311: wire receiving groove | |
| 400: handle | |
| 500: second rotation bar | 510: fitting rod |
| 600: armrest | 610: armrest plate |
| 611: first fixing part | 612: second fixing part |
| 613: fixing piece | 614: first fixing pin |
| 620: cushion member | |
| 700: third frame | 710: second rotation limiter |
| 800: fourth frame | |
| 900: fifth frame | 910: fixing bar |
| 911: sighthole | 920: second fixing pin |
| 1000: sixth frame | 1010: angle control bar |
| 1011: second fixing hole | |
| 1100: saddle | |
| 1200: backrest | |
| 1300: foot plate | |
| 1400: seventh frame | |

The invention claimed is:

1. An arm curl fitness apparatus comprising:

a first frame (100) comprising a pair of standing uprights each in a straight bar shape and configured to be respectively provided laterally proximate to two arms of a user;

a second frame (200) formed in a U-shape with two ends, each end coupled to an upper end of a respective one of the pair of standing uprights of the first frame (100), the second frame (200) inclined upwardly toward a rear of the arm curl fitness apparatus and comprising opposing lateral projections each provided with a fixed pulley (10);

a pair of first rotation bars (300), each first rotation bar (300) respectively shorter than the pair of standing uprights of the first frame (100), disposed downwardly, and comprising a first end rotatably coupled to an upper outer side of a respective one of the pair of standing uprights of the first frame (100);

a pair of handles (400), each handle (400) formed in an L-shape and comprising a first end rotatably coupled to a second end of a respective one first rotation bar(300) and a second end configured to face the user;

a pair of second rotation bars (500), each second rotation bar (500) disposed to be inclined downwardly toward the rear of the arm curl fitness apparatus and comprising a first end rotatably coupled to a lower outer side of a respective one of the pair of standing uprights of the first frame (100), and a second end fitted with a predetermined weight (20);

a pair of wires (30), each wire (30) comprising a first end connected to a point adjacent to the first end of a respective one of the pair of first rotation bars (300), and a second end connected to a point adjacent to the second end of a respective one of the pair of second rotation bars (500) while wrapping around an upper side of a respective one of the fixed pulleys (10); and a pair of armrests (600), each armrest (600) respectively provided on an inside of an upper part of a respective one of the pair of standing uprights of the first frame (100) and configured to support a triceps of the user from a rear of the respective arm of the user, wherein each armrest (600) adjusts the angle of inclination relative to a ground surface.

2. The arm curl fitness apparatus of claim 1, wherein each of the pair of standing uprights of first frame (100) comprises a fixed plate (110) erected toward the rear of the arm curl fitness apparatus at a point adjacent to the respective armrest (600);

wherein the respective armrest (600) comprises an armrest plate (610) formed from a first fixing part (611) and a second fixing part (612) extending orthogonal to each other, the first fixing part (611) is rotatably coupled to the inside of the upper part of the respective one of the pair of standing uprights of the first frame (100), and a fixing piece (613) protrudes outwardly from an outer side of the second fixing part (612); and a pair of cushion members (620) are respectively provided on an inner surface of the first fixing part (611) and an inner surface of the second fixing part (612), wherein the fixing piece (613) is provided with a first fixing pin (614) selectively insertable into one of a plurality of first fixing holes (111) formed through the fixed plate (110);

along an imaginary fixing line on which the first fixing pin (614) is positioned according to a rotation of the armrest (600).

3. The arm curl fitness apparatus of claim 1, wherein a pair of guide plates (310) are erected toward the rear of the arm curl fitness apparatus and are respectively provided integrally with the pair of first rotation bars (300) so as to form a semicircle around the first end of each first rotation bar (300) ;

wherein each guide plate (310) has a wire receiving groove (311) recessed along a circumference thereof; and wherein each wire (30) is respectively positioned between the respective circumference and the respective fixed pulley (10) and is guided while being positioned in the respective wire receiving groove (311).

4. The arm curl fitness apparatus of claim 1, further comprising:

a third frame (700) formed in a U-shape with two ends, each end coupled to a lower end of a respective one of the pair of standing uprights of the first frame (100), the third frame (700) arranged horizontally toward the rear of the arm curl fitness apparatus and placed on the ground surface;

a fourth frame (800) connecting the two ends of the third frame (700);

a fifth frame (900) vertically connecting a center of the second frame (200) and a center of the third frame (700);

a sixth frame (1000) hinged to an upper center of the third frame (700) to rotate in a front-rear direction of the arm curl fitness apparatus;

a saddle (1100) coupled to the sixth frame (1000) to support a buttocks of the user; and a backrest (1200) coupled to an upper side of the saddle on the sixth frame (1000) to support a back of the user, wherein the sixth frame (1000) comprises an angle control bar (1010) having a first end hinged to a rear of the sixth frame (1000), the angle control bar (1010) extending along a longitudinal direction thereof toward the fifth frame (900) and comprising a plurality of second fixing holes (1011) penetrated in the longitudinal direction of the angle control bar (1010); and wherein the fifth frame (900) comprises a protruding fixing bar (910) extending toward the sixth frame (1000) and into which the angle control bar (1010) is inserted, the protruding fixing bar (910) comprises a second fixing pin (920) penetrating the protruding fixing bar (910) and selectively passing through any one of the plurality of second fixing holes (1011).

5. The arm curl fitness apparatus of claim 4, wherein the saddle (1100) is coupled to the sixth frame (1000) so as to be movable along a longitudinal direction of the sixth frame (1000) and fixed at one point.

* * * * *